US005506908A

United States Patent [19]

Baumhauer, Jr. et al.

[11] Patent Number: 5,506,908

[45] Date of Patent: Apr. 9, 1996

[54] DIRECTIONAL MICROPHONE SYSTEM

[75] Inventors: John C. Baumhauer, Jr., Indianapolis; Jeffrey P. McAteer, Fishers; Alan D. Michel; Christopher T. Welsh, both of Noblesville, all of Ind.; Kevin D. Willis, Owensboro, Ky.

[73] Assignee: AT&T Corp., Murray Hill, N.J.

[21] Appl. No.: 268,462

[22] Filed: Jun. 30, 1994

[51] Int. Cl.[6] ..... H04R 3/00

[52] U.S. Cl. ..... 381/92

[58] Field of Search ..... 381/155, 94, 92

[56] References Cited

U.S. PATENT DOCUMENTS 4,802,227 1/1989 Elko et al. ..... 381/54

5,193,117 3/1993 Ono et al. ..... 381/71

FOREIGN PATENT DOCUMENTS 0000895 1/1989 Japan ..... 381/155

*Primary Examiner*—Scott A. Rogers

*Assistant Examiner*—Jerome Grant, II

*Attorney, Agent, or Firm*—Thomas Stafford

[57] ABSTRACT

Full directional pickup coverage is realized by employing a pickup arrangement which provides a plurality of audio polar directivity patterns, i.e., directional beams. These polar directivity patterns are formed in a unique embodiment of the invention by generating a plurality of frequency independent time-delayed versions of a corresponding plurality of spatially sampled signals and by combining each of the plurality of spatially sampled signals with one or more selected ones of the time delayed versions to generate at least a similar plurality of polar directivity patterns. More specifically, the spatially sampled signals are combined with the delayed versions in such a manner that a greater number of polar directivity patterns can be considered than the number of spatially sampled signals. In a specific embodiment, the spatially sampled signals are acoustic (audio) and a plurality of microphones arranged in a predetermined spatial configuration is employed to obtain them.

16 Claims, 6 Drawing Sheets

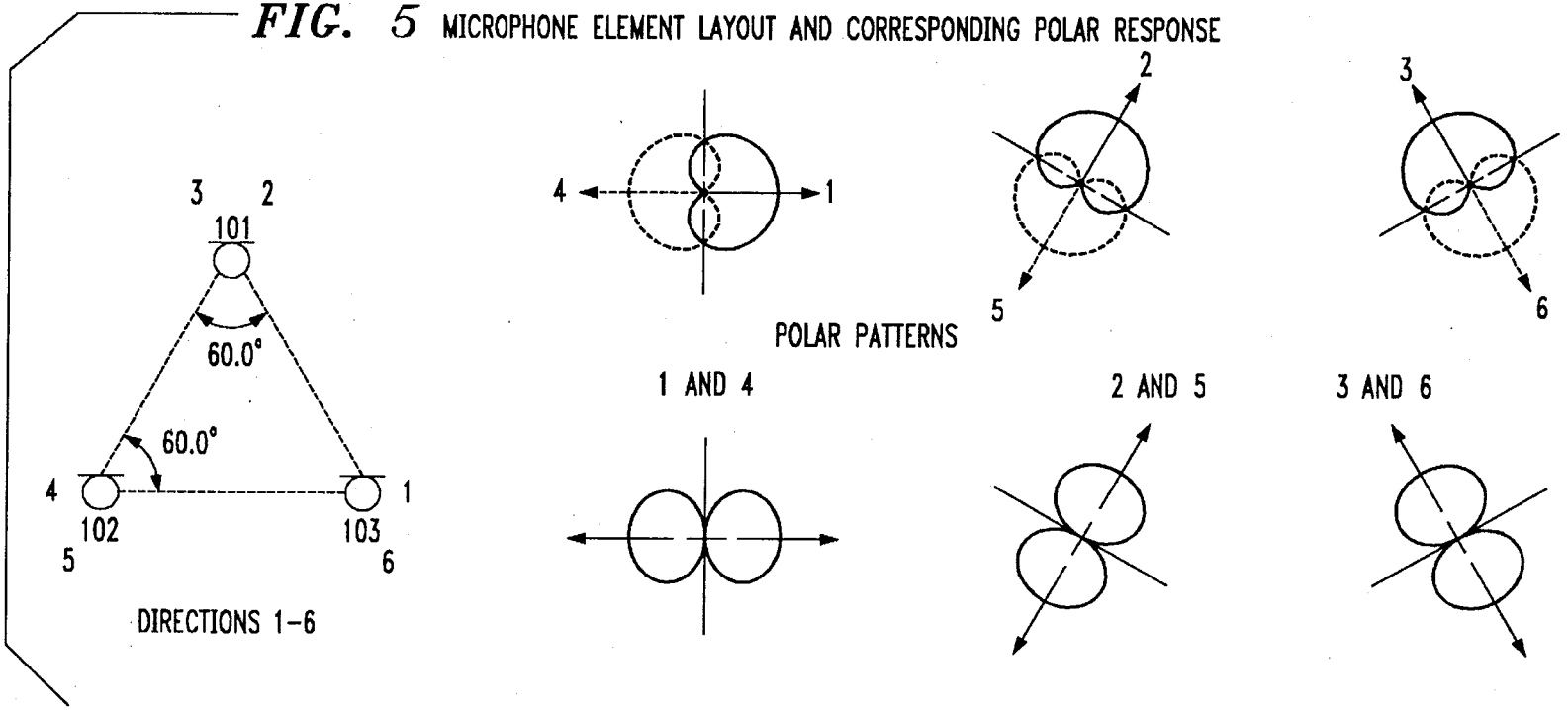
FIG. 5 MICROPHONE ELEMENT LAYOUT AND CORRESPONDING POLAR RESPONSE
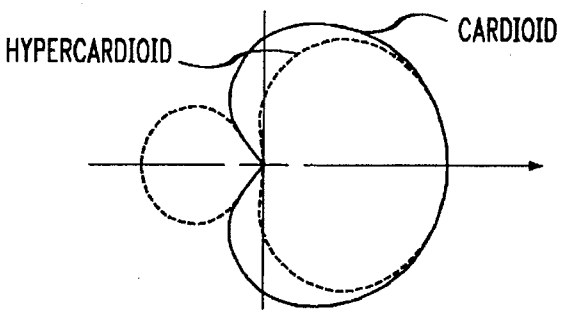
FIG. 5A CARDIOID AND HYPERCARDIOID DIRECTIVITY PATTERNS

*FIG. 8*
MICROPHONE ELEMENT LAYOUT AND CORRESPONDING POLAR RESPONSE
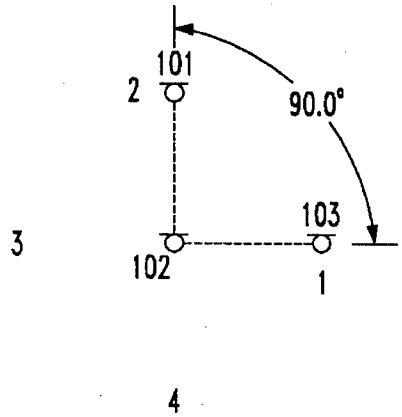
DIRECTIONS 1-4
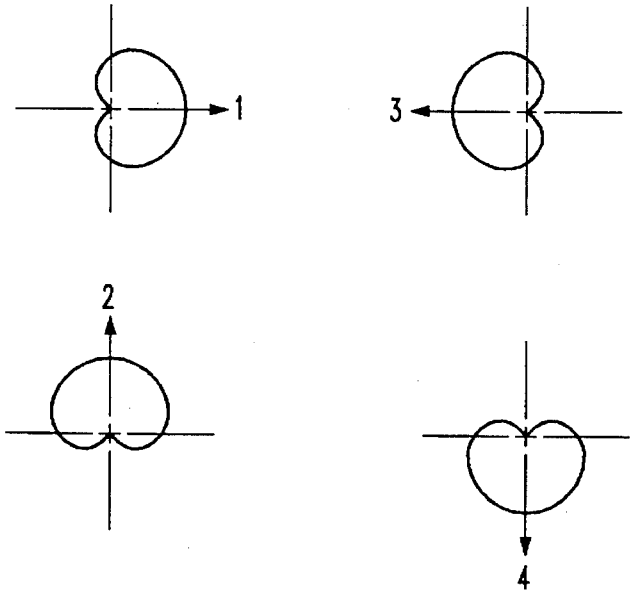
1 AND 3
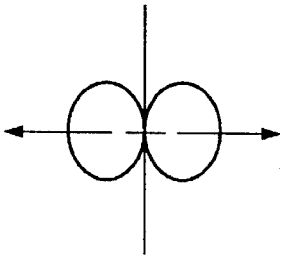
2 AND 4
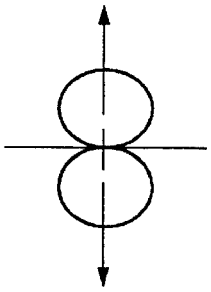

DIRECTIONAL MICROPHONE SYSTEM

CROSS REFERENCE TO RELATED APPLICATIONS

U.S. patent applications Ser. No. 08/268,463 and Ser. No. 08/258,464 were filed concurrently herewith.

TECHNICAL FIELD

This invention relates to microphone systems and, more particularly, to directional microphone systems.

BACKGROUND OF THE INVENTION

In certain audio communications systems it is desirable to have full room audio (acoustic) pickup. One solution to realize full room coverage is to use a single omni-directional microphone. Use of such an omni-directional microphone, however, has several limitations, namely, the pickup of sound echoes or reverberation as well as noise from the room. Moreover, in two-way communications systems using, for example, a speakerphone, the acoustic coupling between the receiving loudspeaker and microphone leads to objectionable echoes and/or annoying switching transients because of the required use of switched loss in the speakerphone.

The limitations of the omni-directional microphone lead to the consideration of using directional microphones in such communications system. Directional gradient type microphone elements using internal acoustic subtraction are commercially available. However, use of the directional gradient type microphone in an apparatus requires a prior knowledge of the location of a talker relative to the apparatus. Consequently, to obtain full room coverage, a plurality of such directional gradient type microphones would be required. This solution, however, is complex and expensive.

SUMMARY OF THE INVENTION

Full directional pickup coverage is realized by employing a pickup arrangement which provides a plurality of polar directivity patterns, i.e., a plurality of directional beams. These polar directivity patterns are formed in a unique embodiment of the invention by generating a plurality of frequency independent time-delayed versions of a corresponding plurality of spatially sampled signals and by combining each of the plurality of spatially sampled signals with one or more selected ones of the time delayed versions to generate at least a similar plurality of polar directivity patterns. More specifically, the spatially sampled signals are combined with the delayed versions in such a manner that a greater number of polar directivity patterns can be considered than the number of spatially sampled signals.

In another embodiment, the spatially sampled signals are also combined with each other in such a manner to form additional polar directivity patterns.

In a specific embodiment, the spatially sampled signals are acoustic (audio) and a plurality of microphones arranged in a predetermined spatial configuration is employed to obtain them.

A technical advantage of the invention is that the number of polar directivity patterns generated to handle the full directional, e.g., room, coverage pickup is greater than the number of microphone inputs required. Another technical advantage is the ability to alter the shape of the audio polar directivity patterns solely through changing the software code.

BRIEF DESCRIPTION OF THE DRAWINGS

FIG. 5 shows polar directivity patterns for the configuration of microphone elements shown in FIG. 2 resulting from employing the embodiment of FIG. 1;

FIG. 5A illustrates cardioid and hypercardioid polar directivity patterns;

FIG. 8 shows polar directivity patterns for the configuration of microphone elements shown in FIG. 7 resulting from employing the embodiment of FIG. 6.

DETAILED DESCRIPTION

Figure 1:
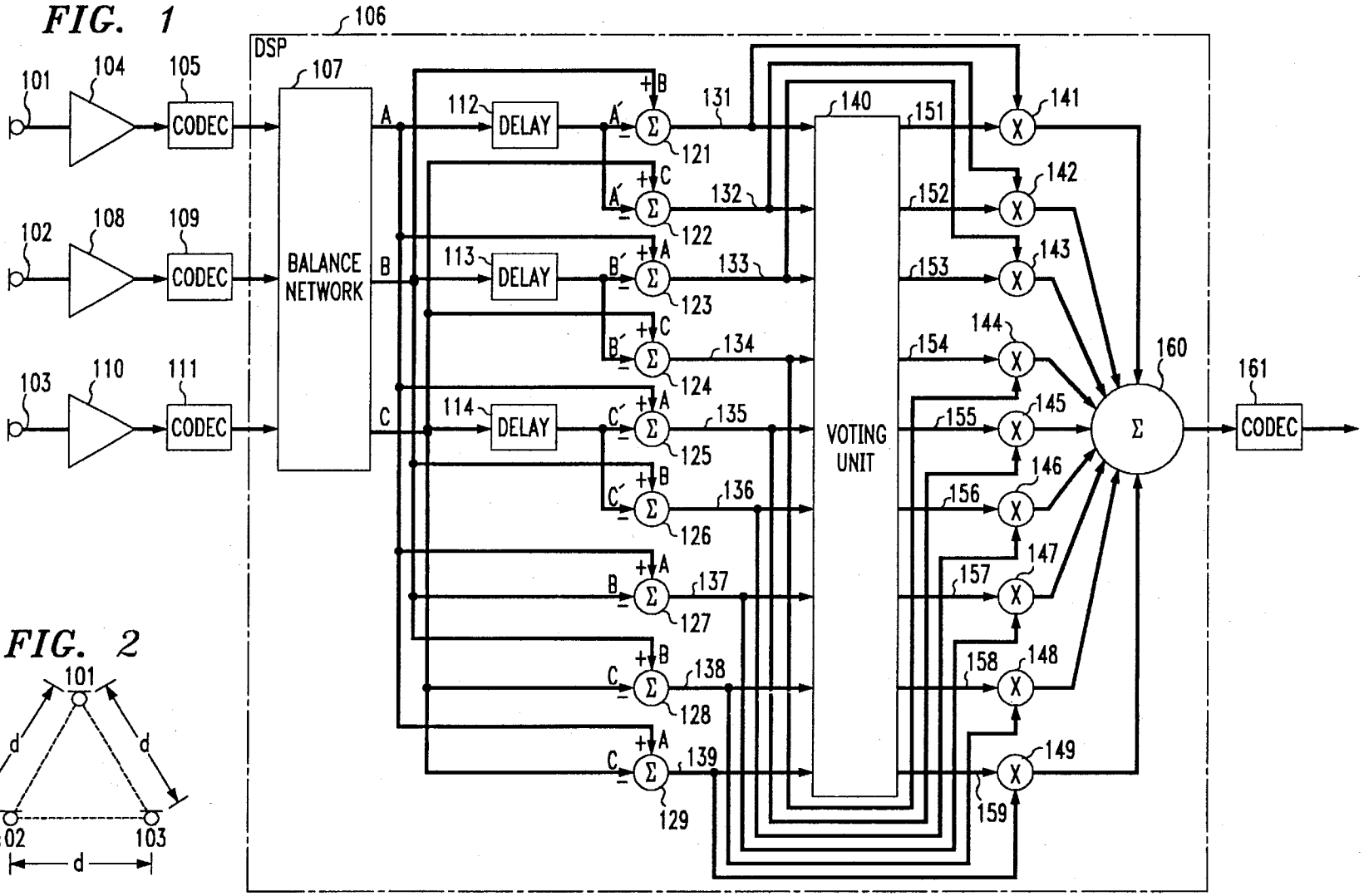
FIG. 1 is a signal flow diagram illustrating a directional microphone system employing one embodiment of the invention.

FIG. 1 illustrates in simplified form a signal flow diagram for signal channels associated with three microphone elements employing one embodiment of the invention. It is noted that the signal flow diagram of FIG. 1 illustrates the signal flow processing algorithm which may be employed in a digital signal processor (DSP) to realize the invention. It is noted, however, although the preferred embodiment of the invention is to implement it on such a digital signal processor, that the invention may also be implemented as an integrated circuit or the like. Such digital signal processors are commercially available, for example, the DSP 1600 family of processors available from AT&T.

Figure 2:
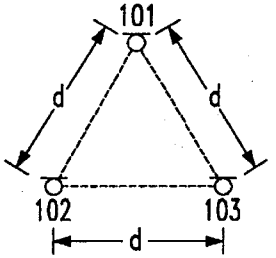
FIG. 2 shows the spatial relationship of the microphone elements employed in the embodiment of FIG. 1.
Figure 3:
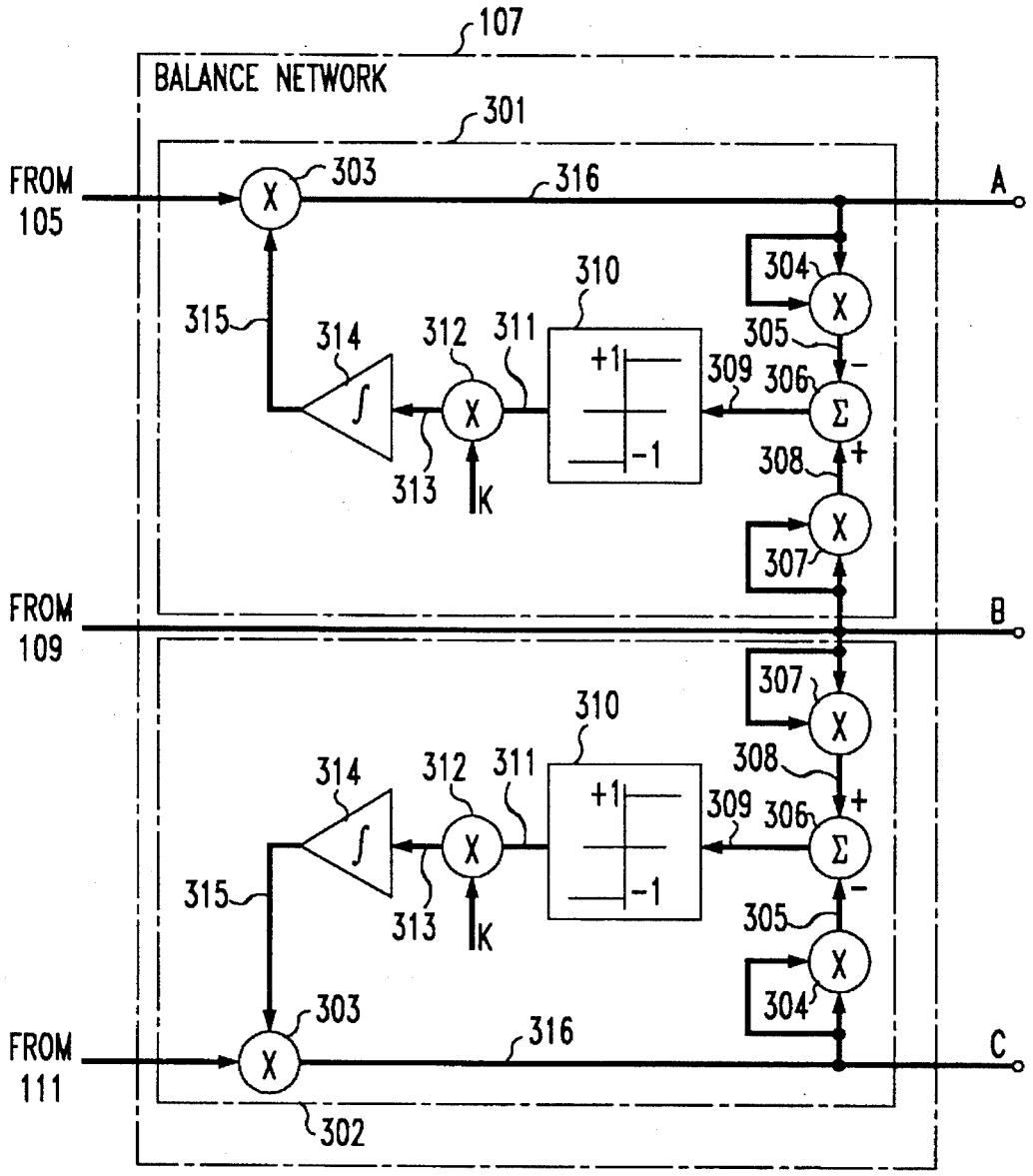
FIG. 3 shows a signal flow diagram for the balance network employed in the embodiments shown in FIGS. 1 and 6.

Shown in FIG. 1 are microphone elements 101, 102 and 103, which in this embodiment, are arranged in an equilateral triangle as shown in FIG. 2. As shown in FIG. 2, microphone elements 101,102 and 103 are placed at the vertices of the equilateral triangle with a predetermined spacing "d" between the vertices. In this example, the spacing d between the vertices is approximately 0.85 inches. An output signal from microphone element 101 is supplied via amplifier 104 and Codec 105 to DSP 106 and therein to balance network 107. DSP 106 includes the digital signal flow processing to realize the invention. Also shown is microphone element 102 whose output is supplied via amplifier 108 and Codec 109 to DSP 106 and therein to balance network 107. Finally, an output signal from microphone element 103 is supplied via amplifier 110 and Codec 111 to DSP 106 and therein to balance network 107. In one example, employing the invention, microphone elements 101, 102 and 103 are so-called omni-directional microphones of the well-known electret-type. Although other types of microphone elements may be utilized in the invention, it is the electret type that are the preferred ones because of their low cost. Codecs 105, 109 and 111 are also well known in the art. One example of a Codec that can advantageously be employed in the invention is the T7513B Codec, also commercially available from AT&T. In this example, the digital signal outputs from Codecs 105, 109 and 111 are encoded in the well-known mu-law PCM format, which in DSP 106 must be converted into a linear PCM format. This mu-law-to-linear PCM conversion is well known. Balance network 107 is employed to balance, i.e., match, the long term average broad band gain of the signal channels associated with microphone elements 101, 102 and 103 to one another. In this example, the long term average broad band gain of the signal channels associated with microphone elements 101 and 103 are balanced to the signal channel associated with microphone element 102. Details of balance network 107 are shown in FIG. 3 and described below.

More specifically, DSP 106 first forms a plurality of polar directivity patterns to provide full pick up coverage of a particular space, for example, a room, stage, arena, area or the like and then vote on the polar directivity pattern (or patterns) that has the best signal-to-noise ratio, thus picking up the desired signal source. In this example, the polar directivity patterns are acoustic (audio) and are in predetermined spatial orientation relative to each other in order to provide full 360° coverage of the particular space. To this end the balanced microphone signal channel outputs A, B and C corresponding to microphones 101,102 and 103, respectively, from balance network 107 are delayed by delay units 112, 113 and 114, respectively. In this example, each of delay units 112, 113 and 114 provides a time delay interval equivalent to the time that sound takes to travel the distance d from one of the microphone pick up locations to another to yield frequency independent time delayed versions A', B' and C' respectively. The delayed signal outputs A', B' and C' from delay units 112, 113 and 114 are then algebraically combined with the non-delayed versions A, B and C, respectively, from balance network 107 via algebraic summing units 121 through 126 to generate six signals representing cardioid polar directivity patterns. Alternatively, for distance d being twice the above noted value, and the time delay interval being equivalent to one-third the time it takes sound to travel the new distance, hypercardioid polar directivity patterns will be generated for the six polar directivity patterns. FIG. 5A shows the relationship of a cardioid polar directivity pattern (solid outline) and a hypercardioid polar directivity pattern (dashed outline). Note that by further changing the delay interval of each of delay units 112, 113 and 114 and/or the spacing "d", the resulting polar directivity patterns can be changed, as desired. Changing this delay interval is readily realized simply by reprogramming DSP 106.

FIG. 5 illustrates the relationship of the equilateral triangle configuration of microphones 101, 102 and 103 and the resulting six cardioid polar directivity patterns, as well as, the resulting three "FIG. 8" polar directivity patterns which will be discussed below. The six cardioid polar directivity patterns result from the algebraic summing of the delayed versions of the balanced channel signals A', B' and C' with the non-delayed balanced channel signals A, B and C, respectively. Thus, summing unit 121 yields at circuit point 131 a signal (B-A') representative of a cardioid polar directivity pattern having its null in the direction of microphone 101 and having its maximum sensitivity in the direction of microphone 102 (shown in dashed outline in FIG. 5 from direction 2 to direction 5). Summing unit 122 provides at circuit point 132 a signal (C-A') representative of a cardioid polar directivity pattern having its null also in the direction of microphone 101 and having its maximum sensitivity in the direction of microphone 103 (shown in dashed outline in FIG. 5 from direction 3 to direction 6). Summing unit 123 yields at circuit point 133 a signal (A-B') representative of a cardioid polar directivity pattern having its null in the direction of microphone 102 and having its maximum sensitivity in the direction of microphone 101 (shown in solid outline in FIG. 5 from direction 5 to direction 2). Summing unit 124 yields at circuit point 134 a signal (C-B') representative of a cardioid polar directivity pattern having its null in the direction of microphone 102 and having its maximum sensitivity in the direction of microphone 103 (shown in solid outline in FIG. 5 from direction 4 to direction 1). Summing unit 125 yields at circuit point 135 a signal (A-C') representative of a cardioid polar directivity pattern having its null in the direction of microphone 103 and having its maximum sensitivity in the direction of microphone 101 (shown in solid outline in FIG. 5 from direction 6 to direction 3). Summing unit 126 yields at circuit point 136 a signal (B-C') representative of a cardioid polar directivity pattern having its null in the direction of microphone 103 and having its maximum sensitivity in the direction of microphone 102 (shown in dashed outline in FIG. 5 from direction 1 to direction 4). The signals at circuit points 131 through 136, representative of the cardioid polar directivity patterns, are supplied to voting unit 140 and to multiplier units 141 through 146, respectively. The purpose of the cardioid polar directivity patterns generated by summing units 121 through 126 is to pick up single acoustic sources, for example, single talkers. In this example, the six cardioid polar directivity patterns are pointing in predetermined fixed directions and are spaced 60° apart from each other. Algebraic summing units 127, 128 and 129 are employed to derive so-called FIG. 8 polar directivity patterns capable of picking up acoustic sources on opposite sides of the pickup system which are operating simultaneously, for example, two simultaneous talkers. Summing unit 127 provides a signal (A-B) at circuit point 137 representative of a FIG. 8 polar directivity pattern that is sensitive, in this example, to talkers at the ends of a directional line passing through microphones 101 and microphone 102 (shown in FIG. 5 as a FIG. 8 for directions 2 and 5). Summing unit 128 provides a signal (B-C) at circuit point 138 representative of a FIG. 8 polar directivity pattern that picks up, in this example, talkers at the ends of a directional line passing through microphone 102 and microphone 103 (shown in FIG. 5 as a FIG. 8 for directions 1 and 4). Summing unit 129 provides a signal (A-C) representative at circuit point 139 of a FIG. 8 polar directivity pattern that picks up, in this example, talkers at the ends of a directional line passing through microphone 101 and microphone 103 (shown in FIG. 5 as a FIG. 8 for directions 3 and 6). The signals at circuit points 137, 138 and 139 are also supplied to voting unit 140 and to multiplier units 147, 148 and 149, respectively.

Figure 4:
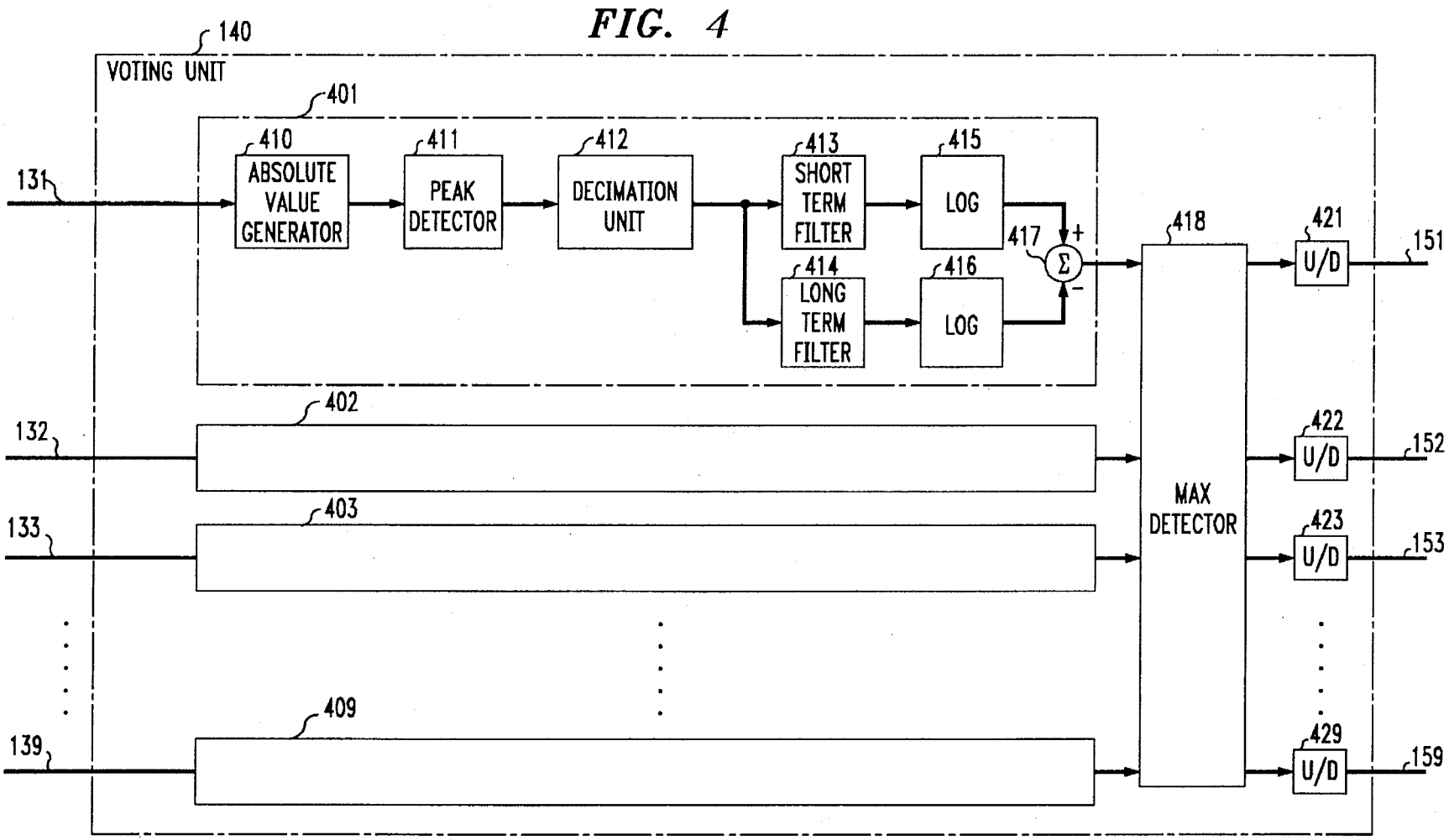
FIG. 4 shows in simplified form details of the voting unit employed in the embodiment of FIG. 1.

Voting unit 140 determines the optimum weighting provided by each of the signal channels 131 through 139 at outputs 151 through 159, respectively. Details of voting unit 140 are shown in FIG. 4 and described below. The signals representative of these weightings from outputs 151 through 159 are also supplied to multipliers 141 through 149 respectively, to weight each channel in accordance with its desirability to be represented in the output. Algebraic summing unit 160 algebraically combines the weighted output signals from each of multipliers 141 through 149. Then, Codec 161 converts the summed output signal into an analog form. The output of Codec 161 is then transmitted as desired.

FIG. 3 shows in simplified form a signal diagram illustrating the operation of balance network 107. The mu-law PCM output from each of Codecs 105, 109 and 111 is converted to linear PCM format (not shown) in DSP 106.

Then, the linear PCM representations of the outputs from Codec 105 and Codec 111 are supplied to gain differential correction factor generation units 301 and 302, respectively. Because the long term average broad band gain of the microphone signal channels corresponding to microphones 101 and 103 are being matched to the signal channel of microphone 102, in this example, the linear PCM format output of Codec 109 does not need to be adjusted. Since each of gain differential correction factor generation units 301 and 302 is identical and operates the same, only gain differential correction factor generation unit 301 will be described in detail. To this end, the elements of each of gain differential correction factor generation units 301 and 302 have been labeled with identical numbers.

The matching, i.e., balancing, of the long term average broad band gain of the signal channels corresponding to microphone elements 101 and 102 is realized by matching the signal channel level corresponding to microphone element 101 to that of microphone element 102. To this end, the linear PCM versions of the signal from Codec 105 is supplied to multiplier 303. Multiplier 303 employs a gain differential correction factor 315 to adjust the gain of the linear PCM version of the signal from Codec 105 to obtain an adjusted output signal 316, i.e., A, for microphone 101. As indicated above, the linear PCM version of the signal from Codec 109 does not need to be adjusted and this signal is output B from balance network 107. The adjusted output C of balance network 107 is from gain differential correction factor generation unit 302.

The gain differential correction factor 315 is generated in the following manner: adjusted microphone output signal 316 is squared via multiplier 304 to generate an energy estimate value 305. Likewise, the linear PCM version of the output signal from Codec 109 is squared via multiplier 307 to generate energy estimate value 308. Energy estimate values 305 and 308 are algebraically subtracted from one another via algebraic summing unit 306, thereby obtaining a difference value 309. The sign of the difference value 309 is obtained using the signum function 310, in well known fashion, to obtain signal 311. Signal 311 will be either minus one (−1) or plus one (+1) indicating which microphone signal channel had the highest instantaneous energy. Minus one (−1) represents microphone 101, and plus one (+1) represents microphone 102. Multiplier 312 multiplies signal 311 by a constant K to yield signal 313 which is a scaled version of signal 311. In one example, not to be construed as limiting the scope of the invention, K typically would have a value of $10^{-5}$ for a 22.5 ks/s (kilosample per second) sampling rate. Integrator 314 integrates signal 313 to provide the current gain differential correction factor 315. The integration is simply the sum of all past values. In another example, constant K would have a value of $5\times10^{-6}$ for an 8 ks/s sampling rate. Value K is the so-called "slew" rate of integrator 314.

FIG. 4 shows, in simplified block diagram form, details of voting unit 140. Specifically, shown are so-called talker signal-to-noise estimation units 401 through 409. It is noted that each of talker signal-to-noise ratio estimate units 401 through 409 are identical to each other. Consequently, only talker signal-to-noise ratio estimation unit 401 will be described in detail. A signal representative of the cardioid polar directivity pattern generated by summing unit 121 is supplied via 131 to talker signal-to-noise ratio estimation unit 401 and therein to absolute value generator unit 410. The absolute value of the signal supplied via 131 is obtained and is then applied to peak detector 411 in order to obtain its peak value over a predetermined window interval, in this example, 8 ms. The obtained peak value is supplied to decimation unit 412 which obtains the generated peak value every 8 ms, in this example, clearing the peak detector 411 and supplies the obtained peak value to short term filter 413 and long term filter 414. Filters 413 and 414 provide noise guarding of signals from stationary noise sources. Short term filter 413, in this example, is a non-linear first order low pass filter having a predetermined rise time constant, for example, of 8 ms and a fall time, for example, of 800 ms. The purpose of filter 413 is to generally follow the envelope of the detected wave form. Long term filter 414 is also a non-linear first order low pass filter having, in this example, a rise time of 8 seconds and a fall time of 80 ms. The purpose of filter 414 is to track the level of background interference. Ten times the logarithm of the filtered output signal from short term filter 413 is obtained via logarithm (LOG) unit 415 and supplied to one input of algebraic summing unit 417. Similarly, ten times the logarithm of the filtered output signal from long term filter 414 is obtained via LOG unit 416 and supplied to another input of algebraic summing unit 417. The LOG values from LOG units 415 and 416 are algebraically subtracted in algebraic summing unit 417. The resulting difference signal is supplied to maximum (MAX) detector 418. Similarly, the outputs from talker signal-to-noise estimation units 402 through 409 are also supplied to MAX detector 418. MAX detector 418 provides a true output, i.e., a logical 1, for the corresponding talker signal-to-noise estimation unit output having the largest value output during the sampling window, in this example, 8 ms. MAX detector 418 also provides a false, i.e., logical 0, output for the signal channels corresponding to the other talker signal-to-noise estimation units. Additionally, MAX detector 418 provides an output only when a difference between the logarithm of the maximum signal-to-noise ratio value minus the logarithm of the minimum signal-to-noise ratio value obtained during the 8 ms window is greater than a predetermined value, in this example, 3 dB, and when the logarithm of the maximum signal-to-noise ratio value is greater than a second predetermined value, in this example, 15 dB. The outputs from MAX detector 418 are supplied to up/down (U/D) counters 421 through 429. Each of U/D counters 421 through 429 increase their count value by a predetermined value, in this example, 0.05, each time the signal supplied from MAX detector 418 is true up to a predetermined maximum value of, in this example, one (1). Likewise, if the signal supplied from MAX detector 418 to U/D counters 421 through 429 is false, the counters count down by the predetermined value of, in this example, 0.05 to another predetermined value of, in this example, zero (0). Each of counters 421 through 429 count either up or down once every window interval of 8 ms, in this example. When the above noted conditions regarding the values of the logarithm of the maximum and minimum signal-to-noise ratios are not met, all of counters 421 through 429 maintain their present count. The outputs from U/D counters 421 through 429 are the outputs 151 through 159, respectively, of voting unit 140.

Figure 6:
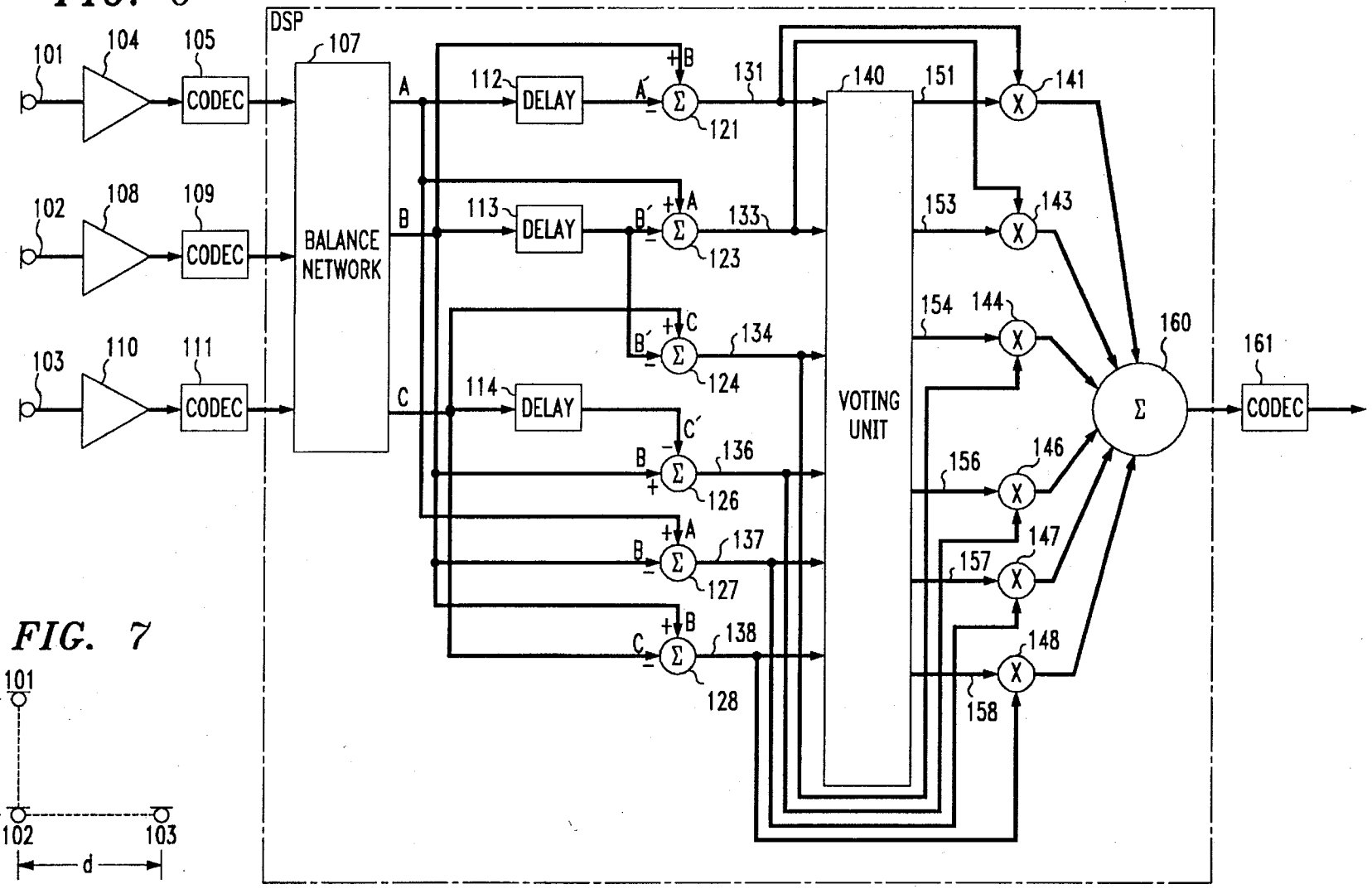
FIG. 6 is a signal flow diagram illustrating a directional microphone system employing another embodiment of the invention.
Figure 7:
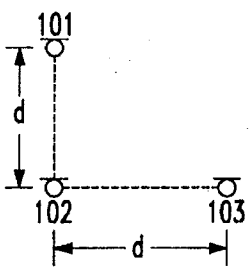
FIG. 7 shows the spatial relationship of the microphone elements employed in the embodiment of FIG. 6.

FIG. 6 illustrates, in simplified form, a flow diagram for signal channels associated with microphone elements 101, 102 and 103 employing another embodiment of the invention. The spatial configuration of microphone elements 101, 102 and 103 in this embodiment, includes two legs extending from a single point at a right angle and having one of the microphones at each end of the legs and at the single point. Thus, as shown in FIG. 7 microphone element 101 is at one end of one of the legs, microphone element 102 is at the single point and microphone element 103 is at the end of the other leg of the right angle. As shown in FIG. 7, the spacing between the microphones is "d". It is noted that the signal flow diagram of FIG. 6 employs some of the elements of the signal flow diagram shown in FIG. 1. The elements which are similar have been similarly numbered and since their operation is identical to that of FIG. 1 they will not be described again in detail. It is noted, however, that instead of employing nine summing units, six of which generated the cardioid polar directivity patterns and three of which generated the FIG. 8 polar directivity patterns in the embodiment of FIG. 1, the embodiment of FIG. 6 employs algebraic summing units 121, 123, 124 and 126 to generate four cardioid polar directivity patterns and algebraic summing units 127 and 128 to generate two FIG. 8 polar directivity patterns. Voting unit 140 generates the weighted signal-to-noise ratio values only for the signals supplied at circuit points 131, 133, 134, 136, 137 and 138 from their associated algebraic summing units. Thus, only six signal channels are being voted on and similarly only those six signal channels are being weighted via multipliers 141, 143, 144, 146, 147 and 148 via weighted outputs 151, 153, 154, 156, 157 and 158, respectively, from voting unit 140. Algebraic summing unit 160 algebraically sums the weighted outputs from multipliers from 141, 143, 144, 146, 147 and 148 to obtain the desired digital output. This digital output is supplied to Codec 161 which converts it to audio form for further transmission as desired.

FIG. 8 illustrates the relationship of the right triangle configuration of microphones 101, 102 and 103 and the resulting four cardioid polar directivity patterns as well as the resulting two FIG. 8 polar directivity patterns. The four cardioid polar directivity patterns result from the algebraic summing of the delayed versions of the balanced channel signals, A', B' and C' with the non-delayed balanced channel signals A, B and C, respectively. Thus, summing unit 121 yields, at circuit point 131, a signal (B-A') representative of a cardioid polar directivity pattern having its null in the direction of microphone 101 and having its maximum sensitivity in the direction of microphone 102 (shown in FIG. 8 from direction 2 to direction 4). Summing unit 123 provides, at circuit point 133, a signal (A-B') representative of a cardioid polar directivity pattern having its null in the direction of microphone 102 and having its maximum sensitivity in the direction of microphone 101 (shown in FIG. 8 from direction 4 to direction 2). Summing unit 124 yields, at circuit point 134, a signal (C-B') representative of a cardioid polar directivity pattern having its null also in the direction of microphone 102 and having its maximum sensitivity in the direction of microphone 103 (shown in FIG. 8 from direction 3 to direction 1). Summing unit 126 yields, at circuit point 136, a signal (B-C') representative of a cardioid polar directivity pattern having its null in the direction of microphone 103 and having its maximum sensitivity in the direction of microphone 102 (shown in FIG. 8 from direction 1 to direction 3). Again, the signals at circuit points 131, 133, 134 and 136 are supplied to voting unit 140 and to multiplier units 141,143, 144 and 146, respectively. The purpose of the cardioid polar directivity patterns generated by summing units 121,123, 124 and 126 is also to pick up single acoustic sources. Algebraic summing units 127 and 128 are employed to derive so-called FIG. 8 polar directivity patterns capable of picking up acoustic sources on opposite sides of the pick up system which are operating simultaneously, for example, two simultaneous talkers. Summing unit 127 provides a signal (A-B) at circuit point 137 representative of a FIG. 8 polar directivity pattern that is sensitive, in this example, to talkers at the ends of a directional line passing through microphones 101 and 102 shown in FIG. 8 as a FIG. 8 for directions 2 and 4. Summing unit 128 provides a signal (B-C) at circuit point 138 representative of a FIG. 8 polar directivity pattern that picks up, in this example, talkers at the ends of a directional line passing through microphone 102 and microphone 103 shown in FIG. 8 as a FIG. 8 for directions 1 and 3.

Although the embodiments of the invention have been described in the context of picking up acoustic (audio) signals, it will be apparent to those skilled in the art that the invention can also be employed to pick up other energy sources; for example, those which radiate radio frequency waves, ultrasonic waves, or other acoustic waves in liquids and solids or the like.

What is claimed:

1. A directional pickup system comprising:

a plurality of means for generating frequency independent time-delayed versions of a corresponding plurality of spatially sampled signals; and means for combining each of the plurality of spatially sampled signals with one or more predetermined ones of the time delayed versions to generate representations of at least a similar plurality of polar directivity patterns, said means for combining including means for combining each of the plurality of spatially sampled signals with selected ones of the time delayed versions to generate a number of polar directivity patterns which is greater than said plurality of spatially sampled signals.

2. The system as defined in claim 1 wherein said means for generating includes means for selecting delay intervals based on prescribed criteria for a particular polar directivity pattern.

3. The system as defined in claim 1 wherein said means for combining includes means for algebraically subtracting each of the plurality of spatially sampled signals from selected ones of the time delayed versions.

4. The system as defined in claim 1 further including means supplied with said representations of said plurality of polar directivity patterns and being responsive thereto to select the polar directivity pattern that has the highest estimated signal-to-background noise ratio with regard to a desired signal source.

5. The system as defined in claim 1 further including means supplied with said plurality of spatially sampled signals for substantially matching the long term average broad band gain of signal channels associated with said spatially sampled signals to one another.

6. The system as defined in claim 1 wherein at least two polar directivity patterns are generated, each of said polar directivity patterns having a prescribed width and direction that is selected to cover a predetermined area of interest.

7. The system as defined in claim 1 wherein the plurality of polar directivity patterns is six being spaced 60° apart from each other.

8. The system as defined in claim 1 further including a plurality of acoustic transducers for obtaining a plurality of spatially sampled acoustic signals at said single point.

9. The system as defined in claim 8 wherein said acoustic transducers are microphones.

10. The system as defined in claim 9 wherein said plurality of microphones includes three microphones.

11. The system as defined in claim 10 wherein said predetermined spatial relationship is a preferred equilateral triangle having one of said microphones at each of the vertices of said equilateral triangle.

12. The system as defined in claim 10 wherein each of said microphones is an omni-directional type microphone.

13. The system as defined in claim 9 wherein said plurality of microphones includes at least two co-linear omni-directional microphones.

14. The system as defined in claim 9 wherein said microphones are in predetermined spatial relationship to each other.

15. The system as defined in claim 14 wherein said predetermined spatial relationship is a preferred equilateral triangle having one of said microphones at each of the vertices of said equilateral triangle.

16. The system as defined in claim 14 wherein said predetermined spatial relationship includes two legs extending from a single point at a right angle and having one of said microphones at the end of each of said legs and at said single point.

* * * * *